United States Patent [19]

Figone

[11] Patent Number: 4,820,203

[45] Date of Patent: Apr. 11, 1989

[54] MULTICONTACT CONNECTOR

[75] Inventor: Frank M. Figone, Belmont, Calif.

[73] Assignee: Raychem Corporation, Menlo Park, Calif.

[21] Appl. No.: 143,796

[22] Filed: Jan. 14, 1988

[51] Int. Cl.[4] ..... H01R 13/66

[52] U.S. Cl. ..... 439/620; 333/185

[58] Field of Search ..... 333/181–185; 439/620–622

[56] References Cited

U.S. PATENT DOCUMENTS

| | | | |
|---|---|---|---|
| 3,271,591 | 9/1966 | Oushinsky | 307/258 |
| 3,343,034 | 9/1967 | Oushinsky | 361/90 |
| 3,993,394 | 11/1976 | Cooper | 339/136 M |
| 4,274,699 | 6/1981 | Keim | 439/751 |
| 4,295,704 | 10/1981 | Narozny et al. | 339/99 R |
| 4,473,755 | 9/1984 | Imai et al. | 439/620 |
| 4,487,464 | 12/1984 | Kirschenbaum | 339/19 |
| 4,575,704 | 3/1986 | Pezold | 439/622 |
| 4,647,717 | 3/1987 | Uken | 439/519 |
| 4,679,885 | 7/1987 | Nestor et al. | 439/620 |
| 4,726,776 | 2/1988 | Billman et al. | 439/620 |
| 4,772,225 | 9/1988 | Ulery | 439/620 |

FOREIGN PATENT DOCUMENTS

| | | | |
|---|---|---|---|
| 0134041 | 6/1986 | Japan | 357/74 |

*Primary Examiner*—Gary F. Paumen

*Attorney, Agent, or Firm*—Simon J. Belcher; Herbert G. Burkard

[57] ABSTRACT

An electrical connector for making connections between first and second sets of conductors, comprising a housing, a plurality of contact pins for connection to respective conductors of each of the first and second sets, and a removable module comprising one or more electronic components which are electrically connected to one or more of the contact pins. The module may comprise components which protect sensitive electrical equipment, connected directly or indirectly to the connector, from a potentially damaging electrical event, for example by comprising a switch which opens to conduct such an event to ground.

11 Claims, 3 Drawing Sheets

MULTICONTACT CONNECTOR

BACKGROUND OF THE INVENTION

This invention relates to a multicontact connector for making connections between first and second sets of conductors.

Multicontact connectors are widely used to make connections between first and second sets of conductors, which may be the conductors of a wire bundle or of a multiconductor cable which may be, for example a flat or a round cable. The conductors of one or both sets may be contacts on a piece of equipment, which may be formed as, for example, a plug or a socket to engage a cooperating socket or plug respectively which is connected to another set of conductors.

U.S. Pat. No. 4,295,704 discloses a multicontact connector for terminating a multiconductor cable. The connector body houses electrical contacts, and has a passage formed in its wall which allows the contacts to be probed from outside the body.

U.S. Pat. No. 4,487,464 discloses a multicontact connector for connecting a multiconductor cable to contacts on a printed wiring board. The connector housing has an array of electrical contacts arranged within a cavity within it, and has a slot in its wall for receiving a strip of conductive material which can be used to interconnect predetermined ones of the pins.

It can be desirable to modify or to monitor the signal which is transmitted between the first and second sets of conductors. It can also be desirable to protect sensitive equipment, to which one of the sets of conductors are connected, from damaging voltage surges.

SUMMARY OF THE INVENTION

I have devised a connector comprising a removable module which contains electronic components.

Accordingly, the present invention provides a multicontact connector for making connections between first and second sets of conductors, comprising:

(a) a housing;

(b) a plurality of contact pins for connection to respective conductors of each of the first and second sets; and (c) a removable module comprising one or more electronic components which are electrically connected to one or more of the contact pins.

The connector of the invention has the advantage that it can readily be adapted to suit the requirements of a particular application by selection of a module which houses appropriate electronic components. This also allows the inventory of connectors to be kept small. Furthermore, the connector of the invention allows easy testing, modification and repair, for example by the electronic components within the module, of the contacts, or of the signal that is transmitted along the conductor. Such testing, modification or repair can be conducted without disconnecting the connector, for example by removing the module for testing or replacement or both. The connector is therefore very convenient both to manufacture and to modify, test or repair. Furthermore, when it is necessary to replace an electronic component because it is faulty, the cost of doing so is very much reduced by replacing a module which houses the faulty component compared with replacing the entire connector as would be necessary if the component were an integral part of the entire connector.

The conductors to which the contacts are to be connected may be, for example, the conductors of a cable, or contacts on a piece of equipment. When the connector is one part of a plug and socket combination, one of the sets of conductors will generally be provided by the contacts in the other part of the combination.

When the connector is a round connector, the module will preferably be arc-shaped, the angle of the arc occupied by the module preferably being less than about 90°.

Preferably the connector is a flat connector which is suitable for forming connections to flat cable. This has the advantage that a module can be provided as a planar element which can be fitted on a principal surface of the connector. When the connector is a flat connector, it may be of the type which comprises a shell and one or more housings in the form of wafers within the shell, the wafers housing contact pins for connection to first and second sets of conductors. In this case, when there is one wafer, it will preferably receive a module on one or both of its principal surfaces. When there are two wafers in face to face contact, it is preferred hat each wafer receive a module on its exposed principal surface.

The nature and arrangement of the electronic components in the module will be selected according to the function that they are required to perform. For example, they may be arranged to filter a signal that is to be transmitted between the first and second sets of conductors through a connector. They may be arranged to protect sensitive equipment that is connected, directly or indirectly, to the connector from a potentially damaging electrical event such as high current or voltage, which may be, for example, in the form of a pulse. Such a damaging event may result from a lightning strike on the conductors. The equipment may be protected for example against a signal whose voltage exceeds a predetermined value, whose current exceeds a predetermined value, or whose frequency is outside a predetermined range.

Protection may be influenced by for example the conditions in which the components are operating or by the signal itself. For example sensitive equipment may be protected by use of a material whose resistivity is dependent on temperature, such as a conductive polymer material which has a positive temperature coefficient of resistivity. A suitable material is disclosed in U.S. Pat. No. 4,329,726, and devices for circuit protection which comprise such a material are disclosed in U.S. Pat. No. 4,237,441 and U.S. Pat. No. 4,238,812. The matter disclosed in the listed documents is incorporated herein by these references. Use of a material whose resistivity varies with temperature in this way ensures protection in the event of an external temperature rise or, particularly usefully, in the event of a potentially damaging high current being transmitted in the conductors.

Protection of sensitive equipment may also be made dependent on the signal itself, by being sensitive to a voltage surge. Such protection can be achieved by use of a material or a device as disclosed in any of U.S. patent application Ser. Nos. 014,118 (filed Jan. 30, 1987), 071,537 (filed July 9, 1987), 945,640 (filed Dec. 23, 1986), 092,830 (filed Sept. 3, 1987), 092,833 (filed Sept. 3, 1987), 092,832 (filed Sept. 3, 1987), 099,931 (filed Sept. 23, 1987), 099,947 (filed Sept. 23, 1987), and 099,949 (filed Sept. 23, 1987) and European Patent Application No, 87307830.7. The matter disclosed in the listed documents is incorporated herein by these references.

It is preferred that the electronic components include a threshold switch having an energy to latch (i.e., the electrical energy required to force the switch into its low resistance state) of at least 40 mJ measured on a sample of 10 micrometer thickness and 1 $mm^2$ area using electrical energy of 1 MHz frequency, and in addition or alternatively a current carrying capacity of at least about 20 amps, especially at least about 40 amps. The voltage at which the switch is caused to latch is preferably from about 50 V to about 500 V, especially from 90 V to about 150 V.

It is preferred to use as a threshold switch a composition which comprises:

(a) 15 to 75 atomic % selenium;
(b) 10 to 65 atomic % arsenic; and
(c) 5 to 42 atomic % germanium or, if the composition comprises less than 35 atomic % selenium, 5 to 35 atomic % germanium, in which portions of (a), (b) and (c) (based on the total molar quantity of (a), (b) and (c)) add up to 100%.

Further information on useful switching materials can be found in the patent applications referred to above.

In a particularly preferred arrangement of electronic components in the module, threshold switches are connected to each of the contact pins, between the contact pins and a conductor at a reference potential, and a capacitor is connected in series with each switching element. Further information on this arrangement can be found in U.S. patent application Ser. No. 92,832, referred to above.

It is particularly preferred that the module is provided as a package in which the electronic components are sealed. For example, the module may comprise electronic components with appropriate connectors and sealed within potting material such as an epoxy resin.

Preferably at least one electrical component is connected between at least one of the contact pins and a conductor which, when the connector is in use, is at a reference potential. The said conductor may for example be at ground potential. The conductor at the reference potential may be one of the conductors which is connected to a contact on the connector. When the housing is constructed at least partially of a conductive material, the component may be connected between one of the contact pins and the housing, the housing being at the reference potential. This has the advantage that all of the contact pins in the connector can be connected to signal carrying conductors. These arrangements are particularly preferred when the electronic components are required to protect sensitive electrical equipment, so that a potentially damaging signal transmitted in the conductor or conductors is conducted to ground.

In another arrangement, the contact pins may be arranged in first and second sets for connection respectively to first and second sets of conductors, the connection between respective pins of the first and second sets being made through electronic components in the module. In this way, the signal transmitted through the connector can be modified individually for each contact pin, and the signal passes through one or more electronic components on passing through the connector. This arrangement may be used to protect sensitive electrical equipment by arranging the electronic components to filter the signal passing between each pair of contact pine of the first and second sets. For example the equipment may be protected against a signal of a potentially damaging frequency by arranging the components to filter out frequencies outside a predetermined range.

The connection between the contacts and the module may be made by means of pins which fit into cooperating recesses in the manner of a plug and socket. Preferably, a spur pin is attached at one end to each contact pin and is received at its other end in a recess in the module. The spur pin and the contact pin may be formed as one unit, or they may be formed separately and then joined together, for example by welding or by means of a solder. When the contact pins are arranged in two sets, as described above, each contact pin and spur pin assembly will preferably be approximately L-shaped; the spur pin portions between which the module makes the connections will be provided by one of the arms of the L's, and the conductors will be made through the other arms of the L's.

When the electronic components are provided between the contact pins and a conductor at a reference potential, or are otherwise provided so that only one spur pin is provided for each pair of conductors of the first and second sets, the contact pin and spur pin assembly will preferably be approximately T-shaped; the spur pin portion will be provided by the upright arm of the T, and the connections to the conductors of the first and second sets will be made through the horizontal arms of the T.

Preferably, the module and the housing are provided with a latch so that the module is retained securely on the housing when the housing is in use, when it can be subjected to severe vibration and shock. For example, the module may be retained on the housing by a C-shaped spring or by a screw threaded clamp.

When the connector comprises a shell with one or more housings for the contact pins in the form of wafers, the or each module may be forced against its corresponding housing by the walls of the shell when the module and housing are inserted in the shell. For example, an internal dimension of the shell may decrease gradually as the housing and module are inserted into the shell so that the housing and module, contacting opposite surfaces of the shell, are forced towards one another. This arrangement has the advantage of simplicity, requiring no additional parts or separate assembly steps.

Preferably the connector includes means for sealing the electrical connections between the housing and the module. A preferred form of seal takes the form of a gasket of a sealing material such as a gel or of an elastomeric material such as silicone rubber. The gasket may be positioned between the mating surfaces of the module and the housing, and the seal may be enhanced by forcing the module and the housing towards one another, for example as described above.

DETAILED DESCRIPTION OF THE INVENTION

Figure 1:
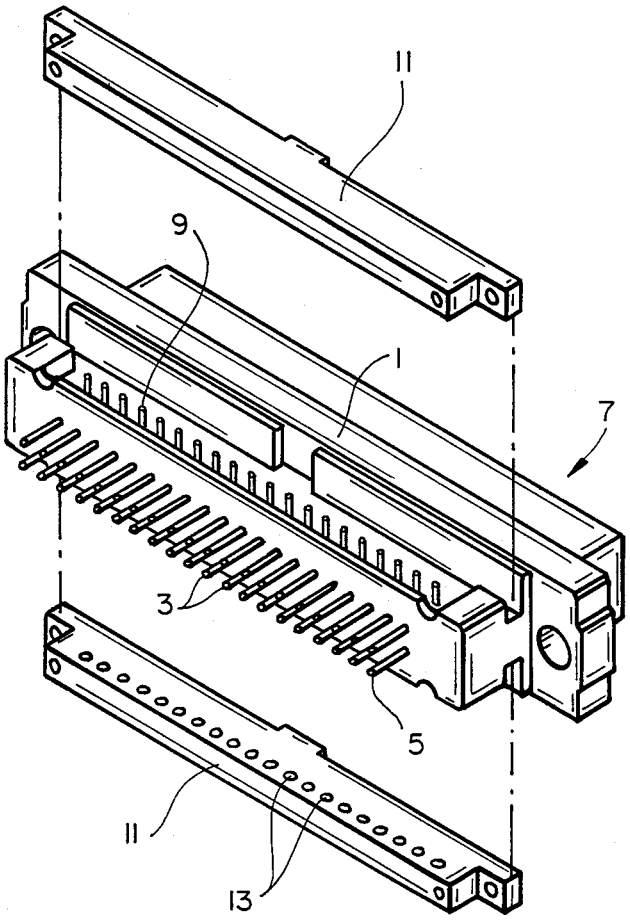
FIG. 1 is an exploded perspective view of a connector according to the present invention.

FIG. 1 shows a connector which comprises a housing 1 and a plurality of contact pins 3 in two layers for connection at one end 5 to a plurality of conductors of a wire bundle, for example by wire wrapping, and for connection at their other end 7 to a cooperating connector (not shown). Each contact pin has a spur pin 9 attached to it, which extends from the contact pin and protrudes above a surface of the connector. A module 11 is fitted on each surface of the connector such that the spur pins 9 are received in recesses 13 therein.

Figure 2:
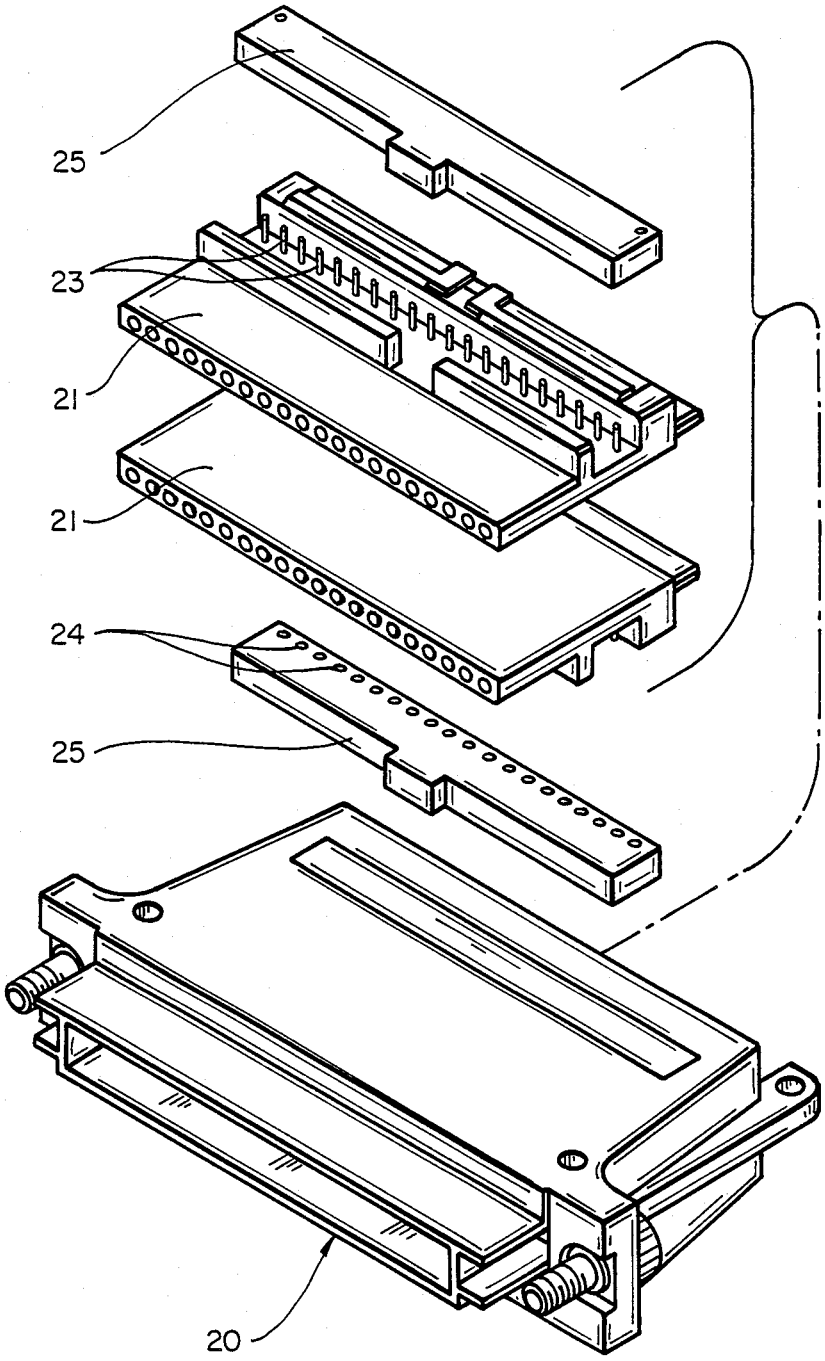
FIG. 2 is an exploded perspective view of another connector according to the present invention.

FIG. 2 shows a connector which comprises a plug shell 20 and a pair of wafers 21. The wafers house contact pins for connection to first and second sets of conductors. Spur pins 23 protrude above the surface of the wafer to engage recesses 24 in a module 25 which houses electronic components. In use, the conductors of a flat cable are connected to the contact pins of one of the wafers 21, the module 25 is located on the spur pins 23, and the wafer is inserted into the plug shell 20 for connection to an appropriate socket, which may be connected to a piece of electrical equipment or to another cable.

Figure 3:
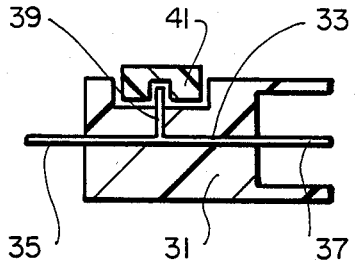
FIG. 3 is a section through a connector showing the arrangement of a contact pin and spur pin assembly.

FIG. 3 shows a connector which comprises a housing 31 having a contact pin 33 extending through it. One end 35 of the pin extends beyond the housing for connection to a conductor of a multiconductor cable, for example by means of a solder. The other end 37 of the pin is recessed within the housing, for mating with a corresponding pin on a cooperating socket. A spur pin 39 is attached at one end to the contact pin 33 and protrudes at its other end above the surface of the housing, for connection to a module 41. The spur pin and contact pin assembly is thus T-shaped. It is preferably formed as one unit.

Figure 4:
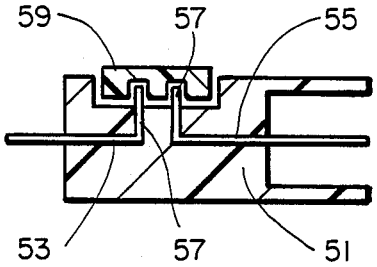
FIG. 4 is a section through another connector showing the arrangement of a contact pin and spur pin assembly.

FIG. 4 shows a connector which comprises a housing 51 having two L-shaped contact pins 53,55. One of the contact pins 53 extends beyond the housing for connection to a conductor of a multiconductor cable. The end of the other contact pin 55 is recessed within the housing, for mating with a corresponding pin on a cooperating socket. Spur pins 57 are attached to each of the contact pins and protrude above the surface of the housing. The spur pins 57 are received within recesses in a module 59 which houses electronic components, by means of which the spur pins, and therefore also the contact pins, are interconnected.

Figure 5:
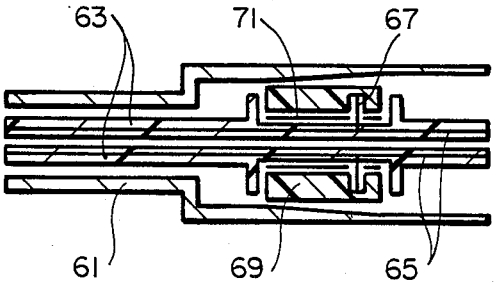
FIG. 5 is a section through a connector showing a seal and means for forcing the module and the housing towards one another.

FIG. 5 shows a connector of the type shown in FIG. 2 which comprises a plug shell 61 and a pair of wafers 63, each of which houses contact pins 65 and spur pins 67. A module 69 is located on the exposed principal surface of each of the wafers 63 where they are electrically connected to the spur pins 67. A layer of silicone rubber 71 is located between the opposing surfaces of the modules and the wafers for sealing the electrical connections between them.

The modules and the wafers are forced towards one another, so as to compress the layers of silicone rubber and therefore to enhance the seal between the modules and the wafers, on insertion into the plug shell 61. This is caused by the gradual decrease in the internal dimension of the shell, from right to left as depicted in FIG. 5 due to the increase in thickness of the wall of the plug shell.

What is claimed is:

1. A multicontact connector for making connections between first and second sets of conductors, comprising:
   (a) a housing;
   (b) a plurality of contact pins mounted in the housing for connection to respective conductors of each of the first and second sets;
   (c) a removable module comprising one or more electronic components which are electrically connected to one or more of the contact pins, the components adapted to alter an electrical signal passing through the pins; and
   (d) a shell having a space within it into which the housing and the module can be inserted, the space being so shaped that the module and pins are forced towards one another when inserted in the shell.

2. A connector as claimed in claim 1, in which one electrical component is connected between at least one of the contact pins and an additional conductor which, when the connector is in use, is at a reference potential.

3. A connector as claimed in claim 2, in which the said additional conductor is at ground potential.

4. A connector as claimed in claim 1, in which the electrical component comprises a threshold switch.

5. A connector as claimed in claim 4, in which the threshold switch has an energy to latch of at least 40 mJ.

6. A connector as claimed in claim 4, in which the threshold switch includes a material which comprises germanium, arsenic and selenium.

7. A connector as claimed in claim 1, in which the contact pins are arranged in first and second sets for connection respectively to the first and second sets of conductors, the connection between respective said pins of the first and second sets being made through the electronic component or components in the module.

8. A connector as claimed in claim 1, in which the connections between the electronic components and the contact pins are made through spur pins, each of which is attached at one end to a respective contact pin and is received at its other end in a recess in the module.

9. A connector as claimed in claim 1, which is a substantially flat connector.

10. A connector as claimed in claim 1, which comprises means for sealing the electrical connections between the contact pins and the module.

11. A connector as claimed in claim 1, in which the housing is in the form of a wafer.

* * * * *